US006018890A

United States Patent [19]

Bowen

[11] Patent Number: 6,018,890

[45] Date of Patent: Feb. 1, 2000

[54] LACE SUBSTITUTE SHOE FASTENING MECHANISM

[76] Inventor: Richard Bowen, 331 Varick St., Jersey City, N.J. 07302

[21] Appl. No.: 09/126,478

[22] Filed: Jul. 30, 1998

[51] Int. Cl.[7] ..... A43C 11/00

[52] U.S. Cl. ..... 36/50.1; 36/50.5

[58] Field of Search ..... 36/50.1, 50.5; 24/68 SK, 69 SK, 70 SK, 71 SK

[56] References Cited

U.S. PATENT DOCUMENTS

| | | | |
|---|---|---|---|
| 3,805,334 | 4/1974 | Graup | 24/70 SK |
| 4,112,557 | 9/1978 | Salomon . | |
| 4,310,951 | 1/1982 | Riedel . | |
| 4,326,320 | 4/1982 | Riedel . | |
| 4,470,175 | 9/1984 | Chiarella | 36/50.5 |
| 4,507,878 | 4/1985 | Semouha . | |
| 4,575,958 | 3/1986 | Arieh et al. | 36/50.5 |
| 4,651,392 | 3/1987 | Olivieri | 36/50.5 |
| 4,683,620 | 8/1987 | Valsecchi et al. . | |
| 4,761,898 | 8/1988 | Courvoisier et al. . | |
| 4,999,889 | 3/1991 | Lecouturer . | |
| 5,148,614 | 9/1992 | Kelly . | |
| 5,259,094 | 11/1993 | Zepeda . | |
| 5,353,483 | 10/1994 | Louviere . | |
| 5,365,679 | 11/1994 | Chemello | 36/50.5 |
| 5,383,258 | 1/1995 | Nicoletti | 24/68 SK |
| 5,469,640 | 11/1995 | Nichols . | |
| 5,471,769 | 12/1995 | Sink . | |
| 5,501,023 | 3/1996 | Miotto | 36/50.5 |
| 5,586,367 | 12/1996 | Benoit . | |
| 5,669,122 | 9/1997 | Benoit | 24/70 SK |

*Primary Examiner*—M. D. Patterson

[57] ABSTRACT

This shoe fastening device particularly for conventional shoes such as sneakers and similar footwear comprises a actuating lever (2) rotatably secured to one flap (26) of an associated shoe (14). Since the fastening of most conventional shoes is effected by laterally directing together their parallel and opposing flaps, the tensioning effected by lever is directed laterally across shoe and is perpendicular to the length of the flaps. This is achieved by orientating the axis of rotation of the lever so that it is parallel with longitudinal median of shoe. Pivotally secured to the actuating lever is an tie element (4) whose axis of rotation is parallel to that of said lever, and where tie element acts as an extension of the lever. An adjunct hook element (12) is attached to tie element. Secured to the opposing flap (27) of shoe is a catch element (6) whose function it is to engage with the adjunct hook element. Upon rotation of actuating lever towards opposing flap, the tie element translates laterally towards and beyond same. Upon rotation of actuating lever away from opposing flap, the tie element translates laterally away from same causing coupling between adjunct hook element and catch element, and the consequent engagement of both upon continuing rotation and tensioning of the lever. To avoid the inadvertent release of tensioning, attached to the lever is a structure (8) which engages a complimentary corresponding structure (10), where complimentary corresponding structure is fixed relative to the lever. Disengagement of structures requires small applied force.

6 Claims, 6 Drawing Sheets

LACE SUBSTITUTE SHOE FASTENING MECHANISM

BACKGROUND

1. Field of Invention

This invention is related to the field of shoe securing and fastening devices, and pertains more particularly to a lace substitute for conventional shoes constructed with dual gaps on opposing sides of a tongue.

2. Discussion of Prior Art

Many shoe lacing systems have been designed to provide a faster and more convenient way of securing a shoe onto the foot. The vast majority of these systems are "lace closure systems" which accomplish this task in part by means of a lace or pliable fibre through which tension is applied. Some examples not withstanding are U.S. Pat. Nos. 5,353,483; 5,469,640; and 5,471,769. Problems inherent in lace closure systems include unwanted tightening of knots caused by tension in laces occurring through everyday use of shoe, and weakening and eventual breakage of lace at points where lace rubs against eyelets of shoe. Lace closure systems may also be impractical and undesirable by persons with rheumatoid arthritis, or persons with weight problems, or injuries which make it difficult for them to bend over for the period of time required to perform lace closure.

Both U.S. Pat. Nos. 5,148,614 and 5,529,094 are designed to achieve relatively rapid fastening by non lace closure methods, but U.S. Pat. No. 5,148,614 still requires somewhat meticulous finger activity and pressure to adjust the strap and effect secure fastening of flaps. U.S. Pat. No. 5,259,094 on the other hand has the convenience of unitary motion for the fastening of a shoe but employs use of many small moving parts which increases the risk of something going wrong rendering the device useless. U.S. Pat No. 4,999,889 uses a lever but still employs use of a lace as an integral means for the transferring of tension and the consequent directing together of opposing flaps and fastening of shoe. This intermediate process is totally eliminated in the present invention and thus eliminates the problems inherent with lace closure methods as mentioned above.

The present invention attempts to overcome the above described deficiencies by describing a shoe fastening system which effects rapid fastening with contiguous motion, as few moving parts, and which is constructed out a rigid durable material such as plastic molding, composite material; or even metal.

3. Objects and Advantages

It is therefore an object of the present invention to provide a new and improved shoe fastening device which effects rapid fastening of shoe.

Another object of the present invention is to provide a new and improved shoe fastening device that is durable and reliable in construction and in particular more durable than conventional lacing systems.

Yet another object of the present invention is to provide a new and improved shoe fastening device which offers adjustable tensioning in such a way so as to allow user to comfortably fasten shoe onto foot.

A further object of the invention is to provide a new and improved shoe fastening device that allows fastening using gross motor hand activity.

Still yet another object of the invention is to provide a new and improved shoe fastening device which can be easily and cost effectively manufactured.

These together with other objects of the invention, along with the features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DETAILED DESCRIPTION OF THE PREFERRED EMBODIMENT

Figure 1:
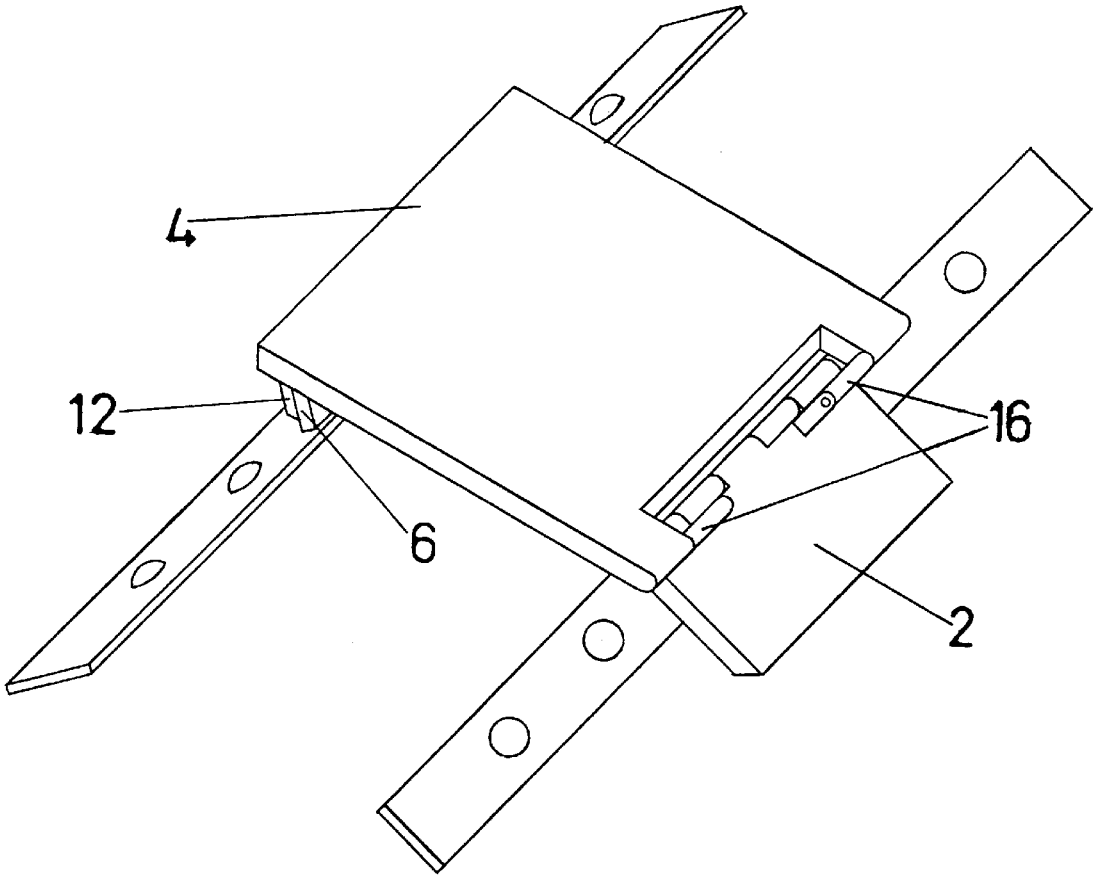
FIG. 1 is an isometric view of the preferred embodiment of the invention.
Figure 2:
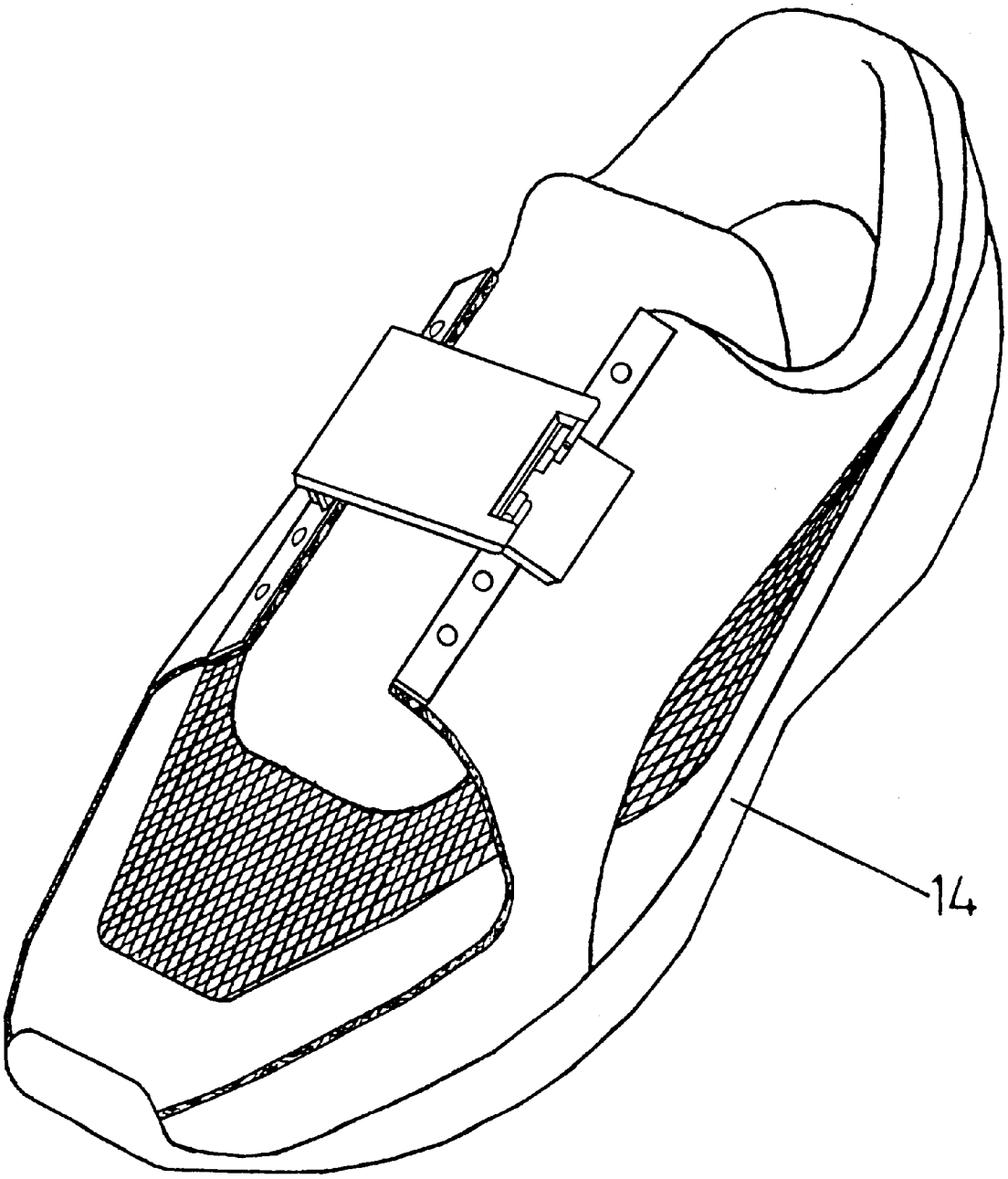
FIG. 2 is an isometric view of the preferred embodiment of the invention on a conventional shoe.
Figure 3:
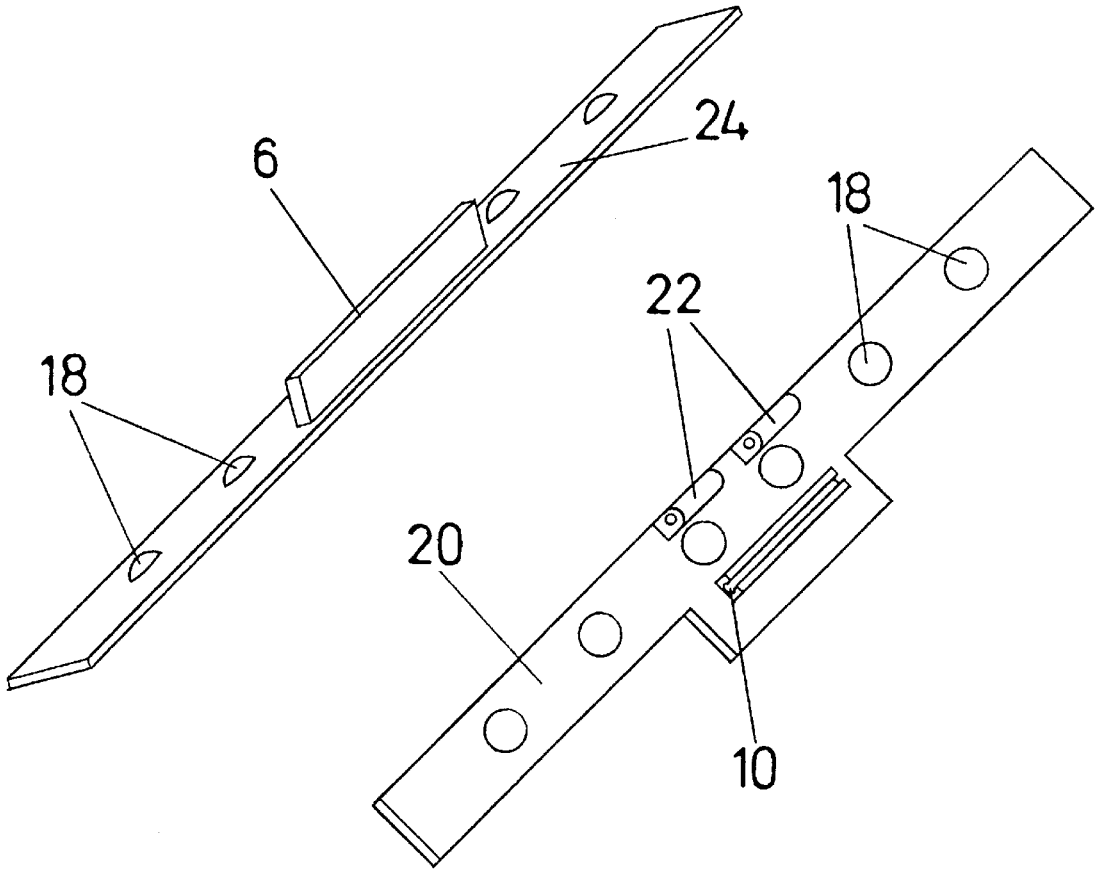
FIG. 3 is an isometric view of the preferred embodiment of the invention with actuating lever and pivotally secured tie element omitted so as to clearly display catch element and complimentary corresponding structure.

With reference to FIG. 1, FIG. 2, and FIG. 3, a actuating lever 2 is pivotally secured via a bearing assemblage 22 adapted to be mounted to a flap of a shoe 14. The bearing mount 20 is fixedly secured to flap 26 of shoe via the use of fasteners 18 or some other industry accepted means of securement. The orientation of the lever is such that the axis of rotation of the lever is parallel to the longitudinal median of the shoe 14, and whereby the direction of tension effected by the lever is directed laterally across said shoe. One end of a planar member 4 (hereafter referred to as tie element), whose shape is fundamentally rectangular is pivotally attached to the actuating lever via appendaged bearing assemblages 16, and extends towards, and retracts away from opposing flap 27 as lever is rotated towards and away from opposing flap respectively. Formed in the underside of tie element 4 as illustrated in FIG. 6 is a series of transverse recesses 30 and protrusions 28 forming a corrugated undersurface.

A hook element 12 comprises three rectangular planar conjoined segments all whose lengths are the same as that of the transverse recesses 30 and protrusions 28 located on the underside of tie element 4. A longitudinal edge of one segment is conjoined to the longitudinal edge of the adjacent segment in such a way that the segments line up end to end, Also, a planar surface on each segment is at an angle to the adjacent planar surface of the adjoining segment in such a way so as to define the integral formed by the three planar segments as a section of a hollow cylinder with uniform throughbore having segmented concave and convex surfaces. The two non-adjacent planar surfaces comprising part of the segmented concave surface of the said integral are at an acute angle to each other. Formed on one of the two non-adjacent surfaces which comprise part of the segmented convex surface of the integral are a series of tranverse recesses 32 and protrusions 34 which run longitudinally along said surface forming the hook element 12 in FIG. 5C. The series of transverse recesses 32 and protrusions 34 are similar to and interengageable with the series of transverse recesses 30 and protrusions 28 formed on the underside of tie element 4.

As shown in FIG. 3, a catch element 6 is formed by a rectangular planar segment which is secured to the opposing flap 27 of shoe 14 via a mount 24. The mount 24 is fastened to the shoe in a manner similar to that of the bearing mount 20. The catch element is attached via one of its longitudinal ends and in a longitudinal manner near to the edge of the mount that lines up flush with the edge of the opposing flap 27 so that its planar faces are perpendicular to the adjoining surface of the mount 24 as shown in FIGS. 4A and 4B.

Figure 6:
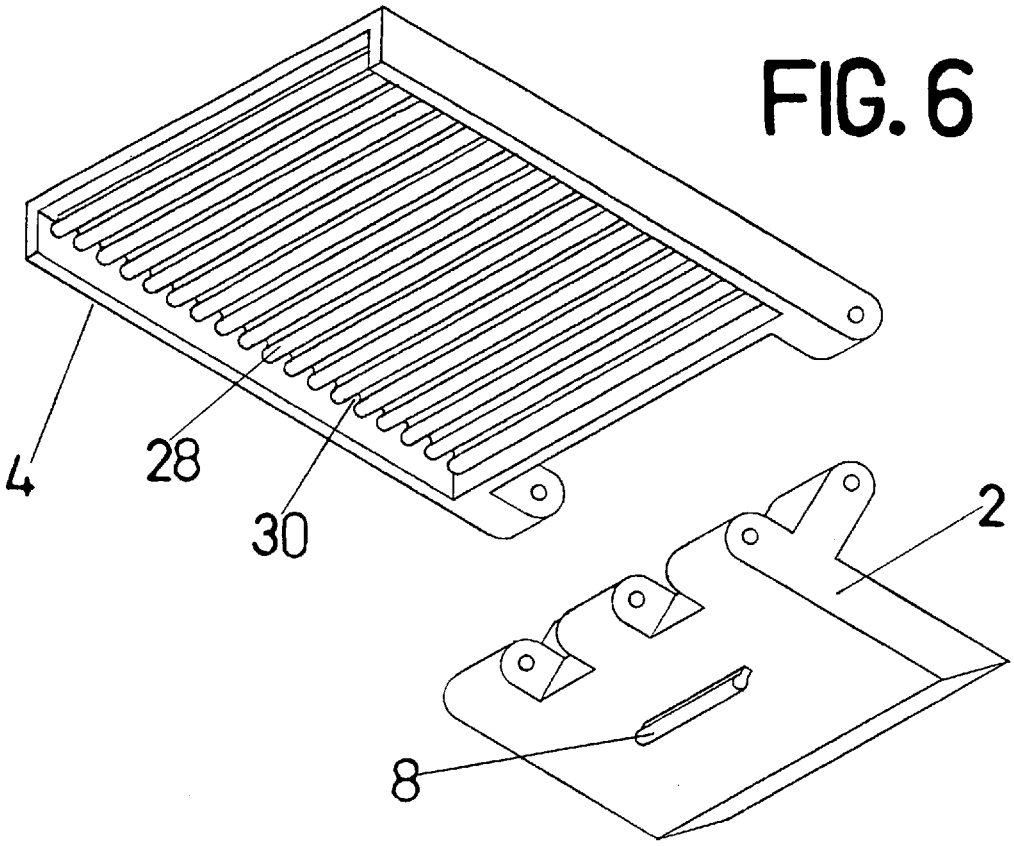
FIG. 6 is an exploded isometric view showing the relationship between actuating lever and tie element.

On the underside of the actuating lever exists a fixed structure 8 as illustrated in FIG. 6, which is fundamentally a planar rectangular segment with one of its longitudinal edges having a uniform circular shaped cross-section with a diameter greater than the thickness of the segment. The segment is transversely appendaged to underside of lever via its other longitudinal edge so that its planar surfaces are perpendicular to the undersurface of lever. The structure 8 engages a complimentary corresponding structure 10 which is formed on the bearing mount 20 and which is the same distance from the axis of rotation of actuating lever as said structure 8 as shown in FIG. 4B.

DESCRIPTION OF OPERATION

Figure 4A:
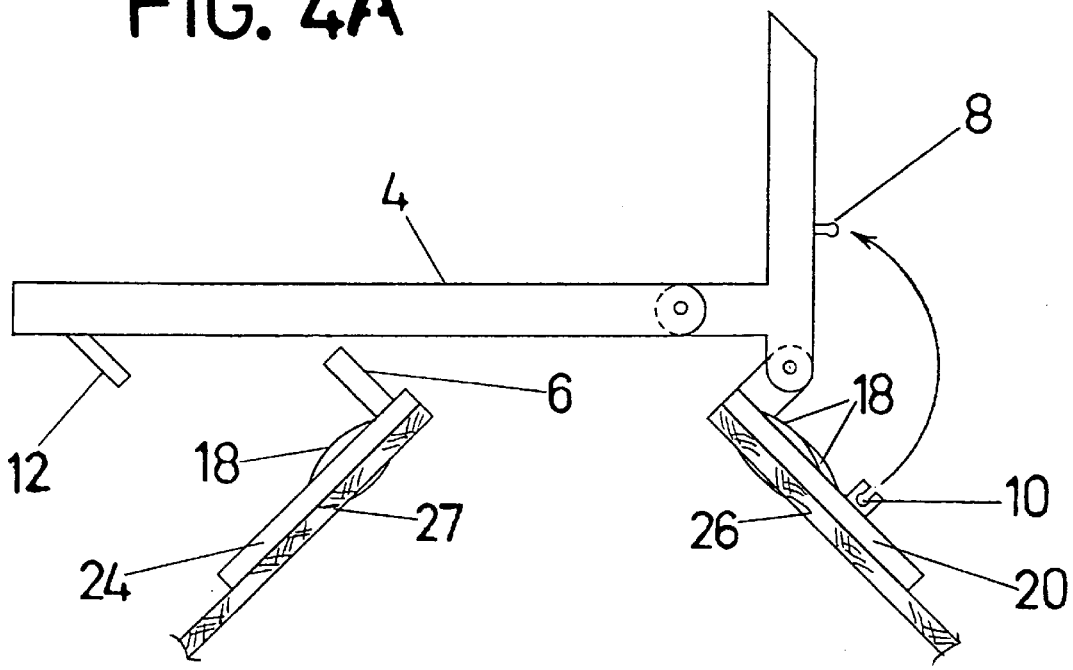
FIGS. 4A–4B are front views showing operation of device.
Figure 4B:
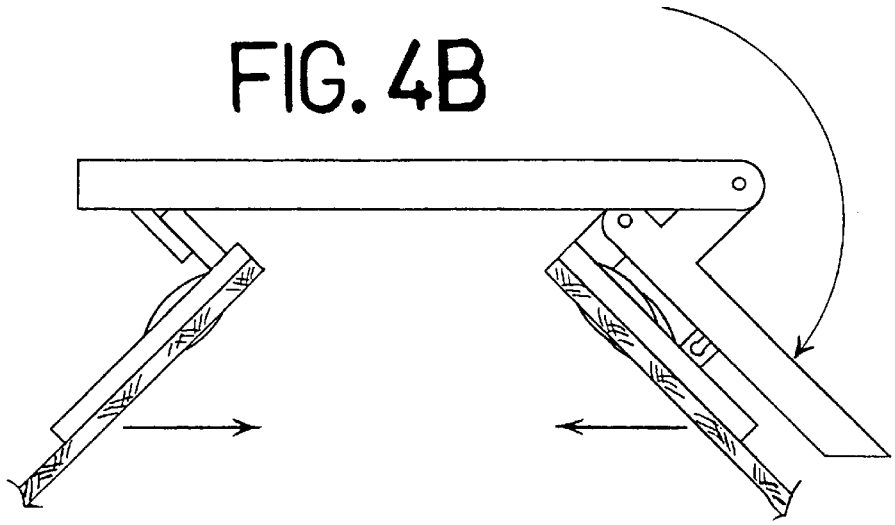
Figure 5A:
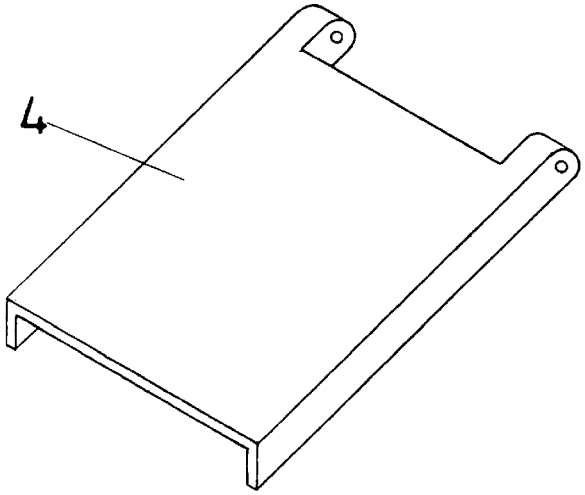
FIGS. 5A–5C are isometric views of tie element, adjunct hook element and both in working combination.
Figure 5B:
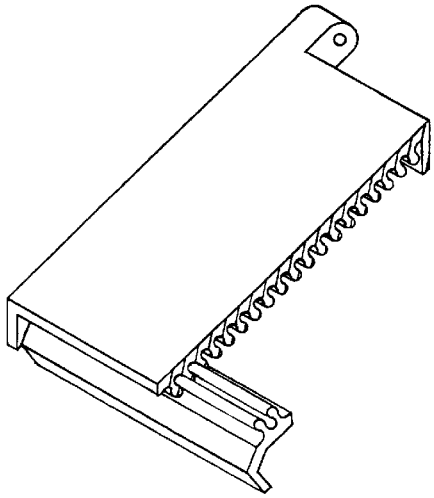
Figure 5C:
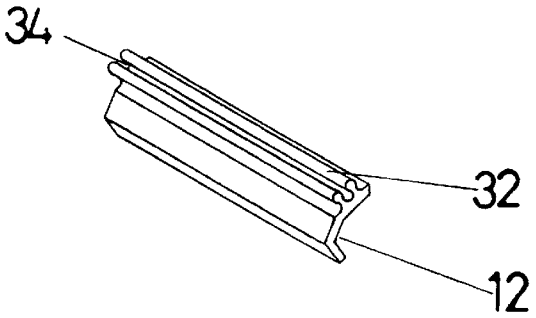

Upward rotatable force is applied to the actuating lever as shown in FIG. 4A, thereby causing tie element 4 with adjunct hook element 12 to extend towards and beyond catch element 6 secured to opposing flap 27. Conversely when downward rotatable force is applied to the lever the tie element retracts causing interengagement between hook element and catch element, thereby effecting tensioning, and resulting in the lateral directing of opposing flaps 26 and 27 towards each other as illustrated in FIG. 4B. With reference to FIGS. 5A through 5C the hook element 12 is detachable and its position longitudinally along the underside of tie element 4 is variable, whereby tensioning effected by the lever is also variable. The hook element is positioned so as to cause the interengagement between same and catch element, resulting in tensioning before completion of downward rotation of lever. Upon the end of the actuating lever's downward rotation and with the application of small force the structure 8 located on the undersurface of lever 4, and the groove 10 formed in the bearing mount 20 become engaged and as a result locks the lever in place so that it cannot inadvertently rotate upward unfastening shoe as illustrated in FIG. 4B. Conversely, application of small opposing force disengages structures whereby tensioning is released as lever is rotated upwards.

SUMMARY OF THE INVENTION

In view of the foregoing disadvantages inherent in the known types of conventional shoe fastening devices now present in the prior art the present invention provides a shoe lacing apparatus wherein the same employs use of a hand actuated lever which is attached to one flap of a shoe, a tie element pivotally attached to said lever that acts as an extension of lever, and where the member has an adjunct hook element, and a catch element secured to the opposing flap of shoe, and where pivotally attached tie element with adjunct hook member extends towards catch element and where catch engages with hook element upon retraction of pivotally secured tie element effecting tensioning of the lever resulting in the directing together of opposing flaps of shoe.

LIST OF REFERENCE NUMERALS

2—actuating lever

4—tie element

6—catch element

8—fixed structure

10—complimentary corresponding structure

12—hook element

14—shoe

16—bearing assemblage pivotally securing tie element to lever

18—fastener

20—bearing mount

22—bearing assemblage on bearing mount for pivotally securing actuating lever

24—catch mount

26—flap of shoe

27—opposing flap of shoe

28—transverse protrusion of undersurface of tie element

30—transverse recess of undersurface of tie element

32—transverse protrusion of hook element

34—transverse recess of hook element

What is claimed is:

1. A shoe and fastening device for directing together dual opposing flap portions of said shoe, said device comprising a bearing mount secured to one of said flap portions, and with at least one bearing assemblage located thereupon, said bearing assemblage defining an axis of rotation substantially parallel to longitudinal median of said shoe; an actuating lever pivotably secured about said axis; a tie element comprising a single component and defining a substantially planar undersurface and hinged onto said actuating lever whereby extending substantially in alignment therewith; at least one hook element projecting from said undersurface of tie element; a catch mount secured to the other flap portion with at least one catch element located thereupon to engage said hook element.

2. The combination of shoe and device of claim 1, where said hook element is a detachable adjunct of said tie element and is refastenable to said tie element at various points along said undersurface of tie element.

3. The combination of shoe and device of claim 2 where said hook element defines a top surface in which recesses and protrusions exist.

4. The combination of shoe and device of claim 2 where in undersurface of said tie element exists a series of recesses and protrusions which can achieve snapped mutual engagement with an adjunct hook element which has a top surface where complimentary interfitting recesses and protrusions exist.

5. The combination of shoe and device of claim 1 whereupon said actuating lever exists at least one fixed structure which can be held in snapped mutual engagement with a complimentary corresponding structure, said complimentary corresponding structure being located on a part of said device that is fixed relative to said actuating lever.

6. The combination of shoe and device of claim 1 whereupon said actuating lever exists a fixed structure which can be held in snapped mutual engagement with a complimentary corresponding structure, said complimentary corresponding structure being located on a part of said shoe that is fixed relative to said actuating lever.

* * * * *